US011811121B2

(12) United States Patent
Tang et al.

(10) Patent No.: US 11,811,121 B2
(45) Date of Patent: Nov. 7, 2023

(54) ELECTRONIC DEVICE COMPRISING A DIELECTRIC SUBSTRATE HAVING A VOLTAGE ADJUSTABLE PHASE SHIFTER DISPOSED WITH RESPECT TO THE SUBSTRATE AND A MANUFACTURING METHOD

(71) Applicants: BEIJING BOE SENSOR TECHNOLOGY CO., LTD., Beijing (CN); BOE TECHNOLOGY GROUP CO., LTD., Beijing (CN)

(72) Inventors: Cuiwei Tang, Beijing (CN); Tienlun Ting, Beijing (CN); Xue Cao, Beijing (CN); Jie Wu, Beijing (CN); Ying Wang, Beijing (CN); Liang Li, Beijing (CN); Haocheng Jia, Beijing (CN); Chuncheng Che, Beijing (CN)

(73) Assignees: Beijing BOE Sensor Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 471 days.

(21) Appl. No.: 16/976,822

(22) PCT Filed: Nov. 29, 2019

(86) PCT No.: PCT/CN2019/122099

§ 371 (c)(1),
(2) Date: Aug. 31, 2020

(87) PCT Pub. No.: WO2021/102956

PCT Pub. Date: Jun. 3, 2021

(65) Prior Publication Data

US 2022/0399625 A1 Dec. 15, 2022

(51) Int. Cl.
*H01P 1/18* (2006.01)
*H01P 11/00* (2006.01)

(52) U.S. Cl.
CPC ..... *H01P 1/184* (2013.01); *H01P 1/181* (2013.01); *H01P 11/003* (2013.01)

(58) Field of Classification Search
CPC .. H01P 1/181; H01P 1/18; H01P 1/184; H01P 9/00

(Continued)

(56) References Cited

U.S. PATENT DOCUMENTS 3,996,536 A 12/1976 Camisa et al.
6,433,375 B1 * 8/2002 Carlsson et al. ..... H01P 7/082 257/295

(Continued)

FOREIGN PATENT DOCUMENTS

CN 1806331 A 7/2006
CN 101283480 A 10/2008

(Continued)

OTHER PUBLICATIONS

First Chinese Office Action from Chinese Patent Application No. 201980002680.1 dated Jan. 6, 2022.

(Continued)

*Primary Examiner* — Benny T Lee
(74) *Attorney, Agent, or Firm* — Dilworth & Barrese, LLP.; Michael J. Musella, Esq.

(57) ABSTRACT

A phase shifter, a manufacture method for manufacturing a phase shifter, a drive method for driving a phase shifter, and an electronic device are provided. The phase shifter includes a dielectric substrate, and a transmission line, a dielectric layer, an insulating layer, and a metal layer on the dielectric substrate. In a direction perpendicular to a first surface of the dielectric substrate, the dielectric layer and the insulating layer are between the metal layer and the transmission line, a material of the dielectric layer is a semiconductor material; and an orthographic projection of the metal layer on the (Continued)

dielectric substrate, an orthographic projection of the insulating layer on the dielectric substrate, and an orthographic projection of the dielectric layer on the dielectric substrate at least partially overlap. The present disclosure provides a new phase shifter based on a metal-insulator-semiconductor capacitor structure.

18 Claims, 8 Drawing Sheets

(58) Field of Classification Search
USPC ..... 333/161
See application file for complete search history.

(56) References Cited

U.S. PATENT DOCUMENTS

| | | | | |
|---|---|---|---|---|
| 6,611,230 | B2 * | 8/2003 | Phelan | H01P 1/181 342/373 |
| 7,109,818 | B2 * | 9/2006 | Rivkina et al. | H01P 1/181 257/295 |
| 9,893,163 | B2 | 2/2018 | Liu et al. | |
| 10,629,973 | B2 | 4/2020 | Jakoby et al. | |
| 2004/0207041 | A1 | 10/2004 | Maaijer | |
| 2005/0063140 | A1 | 3/2005 | Hackler, Sr. et al. | |
| 2006/0006962 | A1 | 1/2006 | Tolt et al. | |
| 2006/0180840 | A1 | 8/2006 | Nishimuta et al. | |
| 2008/0048800 | A1 * | 2/2008 | Dutta | H01P 3/08 333/164 |
| 2020/0099115 | A1 | 3/2020 | Sun | |
| 2021/0265713 | A1 | 8/2021 | Fang et al. | |

FOREIGN PATENT DOCUMENTS

| | | | |
|---|---|---|---|
| CN | 201540938 | U | 8/2010 |
| CN | 103094362 | A | 5/2013 |
| CN | 104037027 | A | 9/2014 |
| CN | 105308789 | A | 2/2016 |
| CN | 109164608 | A | 1/2019 |
| CN | 208805639 | U | 4/2019 |
| CN | 110137636 | A | 8/2019 |
| EP | 3480834 | A1 | 5/2019 |
| WO | 2003009383 | A1 | 1/2003 |

OTHER PUBLICATIONS

Boshi et al., "A Novel Design for the Miniaturization of the DMTL Phase Shifter" Chinese Journal of Sensors and Actuators, pp. 1-4, vol. 19 No. 5.

* cited by examiner

ELECTRONIC DEVICE COMPRISING A DIELECTRIC SUBSTRATE HAVING A VOLTAGE ADJUSTABLE PHASE SHIFTER DISPOSED WITH RESPECT TO THE SUBSTRATE AND A MANUFACTURING METHOD

TECHNICAL FIELD

Embodiments of the present disclosure relate to a phase shifter, a manufacture method for manufacturing a phase shifter, a drive method for driving a phase shifter, and an electronic device.

BACKGROUND

A phase shifter is a device capable of adjusting the phase of a signal (e.g., electromagnetic wave). The phase shifter can be applied to various fields, such as radar, accelerator, wireless communication, instrumentation, etc.

At present, the commonly used phase shifters include a varactor phase shifter, a ferrite phase shifter, a PIN diode phase shifter, a MEMS (Micro-Electro-Mechanical System) phase shifter, a liquid crystal phase shifter, and so on.

The liquid crystal phase shifter is a phase shifter with a liquid crystal as an electro-optic material. The dielectric constant of the liquid crystal can be controlled by applying a bias voltage. With the application of different bias voltages, the dielectric constant of the liquid crystal can change continuously, and thus continuous phase shift adjustment can be achieved. However, the liquid crystal phase shifter generally need to introduce the bias voltage through a transparent conductive oxide film (for example, indium tin oxide (ITO)), and the connection method using ITO is prone to bring a large parasitic inductance and resistance, resulting in distortion of the bias voltage, thereby affecting the phase shift effect of the phase shifter. In addition, due to the limitation of a glass punching technology, an upper glass substrate and a lower glass substrate of the liquid crystal phase shifter need to be connected by a welding method, but the welding method will affect the stability of the frequency response of the liquid crystal phase shifter. In addition, the loss of in the liquid crystal of the liquid crystal phase shifter is large, and the response time of the phase shifter is limited by the inherent characteristics of the liquid crystal.

SUMMARY OF THE INVENTION

An embodiment of the present disclosure provides a phase shifter, comprising a dielectric substrate, and a transmission line, a dielectric layer, an insulating layer, and a metal layer disposed with respect to the dielectric substrate. In a direction perpendicular to a first surface of the dielectric substrate, the dielectric layer and the insulating layer are between the metal layer and the transmission line, and a material of the dielectric layer is a semiconductor material; and an orthographic projection of the metal layer on the dielectric substrate, an orthographic projection of the insulating layer on the dielectric substrate, and an orthographic projection of the dielectric layer on the dielectric substrate at least partially overlap.

For example, in some embodiments, the transmission line is on the first surface of the dielectric substrate; in the direction perpendicular to the first surface of the dielectric substrate, the dielectric layer is between the insulating layer and the transmission line; and the insulating layer is between the dielectric layer and the metal layer.

For example, in some embodiments, the phase shifter further comprises a connection layer, the connection layer is electrically connected to the metal layer.

For example, in some embodiments, the connection layer comprises a ground layer on a second surface of the dielectric substrate away from the first surface.

For example, in some embodiments, the phase shifter further comprises a connection line, the connection line is configured to electrically connect the ground layer and the metal layer.

For example, in some embodiments, the connection layer comprises a first conductor portion, the first conductor portion is on the first surface of the dielectric substrate, and the first conductor portion and the transmission line are spaced apart from each other.

For example, in some embodiments, the connection layer further comprises a second conductor portion, the second conductor portion is on the first surface of the dielectric substrate, and the first conductor portion, the second conductor portion, and the transmission line are all spaced apart from each other.

For example, in some embodiments, on the first surface of the dielectric substrate, an extension direction of the transmission line, an extension direction of the first conductor portion, and an extension direction of the second conductor portion are all in a first direction; the transmission line, the first conductor portion, and the second conductor portion are arranged along a second direction; and in the second direction, the transmission line is between the first conductor portion and the second conductor portion.

For example, in some embodiments, the phase shifter further comprises a voltage control module, and the voltage control module is configured to control a voltage applied between the transmission line and the metal layer.

For example, in some embodiments, the metal layer comprises a plurality of metal blocks spaced apart from each other, and the plurality of metal blocks are all electrically connected to the connection layer, on the first surface of the dielectric substrate, the plurality of metal blocks are arranged along a first direction, and an extension direction of the transmission line is the first direction.

For example, in some embodiments, an orthographic projection of each of the plurality of metal blocks on the dielectric substrate partially overlaps an orthographic projection of the transmission line on the dielectric substrate.

For example, in some embodiments, the dielectric layer comprises a plurality of dielectric sub-layers that are in one-to-one correspondence with the plurality of metal blocks, and the plurality of dielectric sub-layers are spaced apart from each other; and the insulating layer is also between the plurality of dielectric sub-layers.

For example, in some embodiments, an orthographic projection of each of the plurality of metal blocks on the dielectric substrate covers at least an orthographic projection of a corresponding dielectric sub-layer of the plurality of dielectric sub-layers on the dielectric substrate.

An embodiment of the present disclosure also provides an electronic device including the phase shifter according to any of the above embodiments.

An embodiment of the present disclosure also provides a manufacture method for manufacturing a phase shifter, and the manufacture method comprises: providing a dielectric substrate; and forming a transmission line, a dielectric layer, an insulating layer, and a metal layer on the dielectric substrate. In a direction perpendicular to a first surface of the dielectric substrate, the dielectric layer and the insulating layer are between the metal layer and the transmission line, a material of the dielectric layer is a semiconductor material. An orthographic projection of the metal layer on the dielectric substrate, an orthographic projection of the insulating layer on the dielectric substrate, and an orthographic projection of the dielectric layer on the dielectric substrate at least partially overlap.

For example, in some embodiments, forming the transmission line, the dielectric layer, the insulating layer, and the metal layer disposed with respect to the dielectric substrate, comprises: forming the transmission line on the first surface of the dielectric substrate; forming the dielectric layer on a side of the transmission line away from the dielectric substrate; forming the insulating layer on the dielectric substrate on which the dielectric layer is formed, where the insulating layer is formed on a side of the dielectric layer away from the dielectric substrate; and forming the metal layer on a side of the insulating layer away from the dielectric substrate.

An embodiment of the present disclosure also provides a drive method for driving the phase shifter according to any one the above embodiments, and the drive method comprises: applying a first voltage to the transmission line and applying a second voltage to the metal layer to adjust a capacitance value of an equivalent capacitor formed by the metal layer, the insulating layer, the dielectric layer, and the transmission line based on the first voltage and the second voltage.

For example, in some embodiments, applying the first voltage to the transmission line and applying the second voltage to the metal layer to adjust the capacitance value of the equivalent capacitor formed by the metal layer, the insulating layer, the dielectric layer and the transmission line based on the first voltage and the second voltage, comprises: controlling the first voltage to be greater than the second voltage, so that the capacitance value increases as an absolute value of a voltage difference between the first voltage and the second voltage increases, where the capacitance value remains unchanged upon increasing to a first specific value; and/or controlling the first voltage to be less than the second voltage, so that the capacitance value decreases as the absolute value of the voltage difference between the first voltage and the second voltage increases, where the capacitance value remains unchanged upon decreasing to a second specific value.

BRIEF DESCRIPTION OF THE DRAWINGS

In order to clearly illustrate the technical solutions of the embodiments of the present disclosure, the drawings of the embodiments will be briefly described in the following; and it is obvious that the described drawings are only related to some embodiments of the present disclosure and thus are not limitative to the present disclosure.

DETAILED DESCRIPTION OF THE INVENTION

Figure 1:
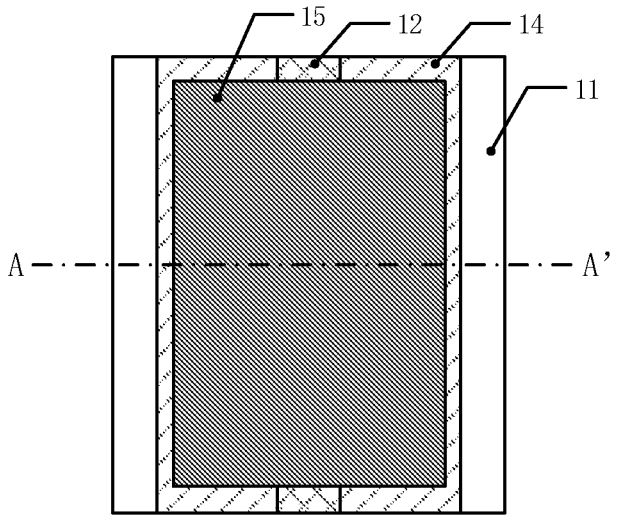
FIG. 1 shows a top view of a structure of a phase shifter according to some embodiments of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

The terms used herein to describe the embodiments of the present disclosure are not intended to limit and/or restrict the scope of the present disclosure. For example, unless otherwise defined, all the technical and scientific terms used herein have the same meanings as commonly understood by one of ordinary skill in the art to which the present disclosure belongs.

It should be understood that the terms "first," "second," etc., which are used in the present disclosure, are not intended to indicate any sequence, amount or importance, but distinguish various components. Unless the context clearly indicates otherwise, the singular form "a", "an", or "the", and other similar words do not indicate a quantitative limitation, but rather indicate the existence of at least one.

It will be further understood that the terms "comprise," "include," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, exemplary embodiments of the present disclosure will be described in detail with reference to the accompanying drawings. In the drawings and in the detail description thereof, the same reference numerals or numbers may refer to components or elements that perform substantially the same function.

In view of various shortcomings of existing liquid crystal phase shifters, embodiments of the present disclosure propose a new phase shifter based on a metal-insulator-semiconductor (MIS) capacitor structure.

Figure 2:
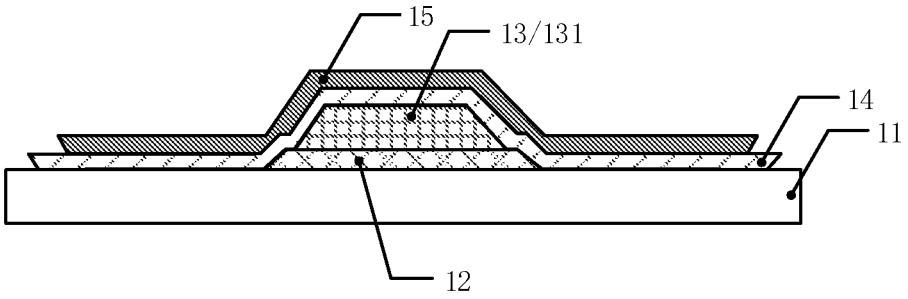
FIG. 2 shows a cross-sectional view of a structure of a phase shifter according to some embodiments of the present disclosure.

FIGS. 1 and 2 show the structure of a phase shifter according to some embodiments of the present disclosure, FIG. 1 is a top view of the structure of the phase shifter, and FIG. 2 is a cross-sectional view of the phase shifter along a line A-A' in FIG. 1.

Referring to FIGS. 1 and 2, the phase shifter may include a dielectric substrate 11, and a transmission line 12, a dielectric layer 13 (FIG. 2), an insulating layer 14, and a metal layer 15, which are disposed with respect to the dielectric substrate 11. In a direction perpendicular to a first surface of the dielectric substrate 11, the dielectric layer 13 and the insulating layer 14 may be disposed between the metal layer 15 and the transmission line 12. A material of the dielectric layer 13 may be a semiconductor material, for example, in some embodiments, the semiconductor material may include amorphous silicon (a-Si), low temperature polysilicon (LTPS), and the like. An orthographic projection of the metal layer 15 on the dielectric substrate 11, an orthographic projection of the insulating layer 14 on the dielectric substrate 11, and an orthographic projection of the dielectric layer 13 on the dielectric substrate 11 at least partially overlap.

For example, the orthographic projection of the dielectric layer 13 on the dielectric substrate 11 may be located within the orthographic projection of the metal layer 15 on the dielectric substrate 11. For another example, the orthographic projection of the dielectric layer 13 on the dielectric substrate 11 may also be located within the orthographic projection of the insulating layer 14 on the dielectric substrate 11.

In an embodiment of the present disclosure, a plurality of equivalent capacitors based on the MIS structure can be formed by the metal layer 15, the insulating layer 14, the dielectric layer 13, and the transmission line 12. By changing equivalent capacitance values of the equivalent capacitors, the phase velocity of the signal (e.g., microwave signal) transmitted by the transmission line 12 can be changed. In addition, because the material of the dielectric layer 13 is a semiconductor material, the capacitance values of the equivalent capacitors can be changed by adjusting the distribution of charges in the dielectric layer 13. Therefore, by adopting the phase shifter according to the embodiment of the present disclosure, the adjustment speed of the equivalent capacitor can be improved, thereby improving the adjustment speed of the phase of the signal transmitted by the transmission line 12. Therefore, the response speed of the phase shifter provided by the embodiment of the present disclosure is fast.

In some embodiments, the orthographic projection of the metal layer 15 on the dielectric substrate 11, the orthographic projection of the insulating layer 14 on the dielectric substrate 11, the orthographic projection of the dielectric layer 13 on the dielectric substrate 11, and the orthographic projection of the transmission line 12 on the dielectric substrate 11 at least partially overlap.

In some embodiments, as shown in FIG. 2, the transmission line 12 may be disposed on the first surface of the dielectric substrate 11. For example, the first surface may be an upper surface of the dielectric substrate 11. In an embodiment of the present disclosure, the transmission line 12 is configured to transmit signals, such as electromagnetic waves (e.g., microwave signals). For example, the transmission line 12 may include microstrip lines, ribbon lines, rectangular waveguides, circular waveguides, and the like. For example, the transmission line may be formed on the first surface of the dielectric substrate 11 by etching, sputtering, or the like. For example, the material of the transmission line 12 may include metals, such as copper, silver, iron, aluminum, and the like.

In some embodiments, as shown in FIG. 2, in the direction perpendicular to the first surface of the dielectric substrate 11, the dielectric layer 13 may be disposed between the insulating layer 14 and the transmission line 12, and the insulating layer 14 may be disposed between the dielectric layer 13 and the metal layer 15.

In some embodiments, the dielectric layer 13 includes a plurality of dielectric sub-layers 131, and the plurality of dielectric sub-layers 131 are spaced apart from each other, and the insulating layer 14 covers the plurality of dielectric sub-layers 131 and further covers gaps between the plurality of dielectric sub-layers 131 to insulate the plurality of dielectric sub-layers 131 from each other.

In some embodiments, the orthographic projection of the metal layer on the dielectric substrate 11 covers at least an orthographic projection of each of the plurality of dielectric sub-layers 131 on the dielectric substrate 11. For example, each dielectric sub-layer 131, the metal layer 25, the insulating layer 24, and the transmission line 22 constitute an equivalent capacitor, that is, the amount of equivalent capacitors included in the phase shifter is the same as the amount of the dielectric sub-layers 131.

In some embodiments, the metal layer 15 may be a metal plate. For example, the material of the metal layer may include copper, silver, iron, aluminum, iron, etc.

In some embodiments, the material of the insulating layer 14 may be any suitable electrical insulating material. For example, the material of the insulating layer 14 may include silicon oxide, silicon nitride, silicon oxynitride, and the like.

Figure 3:
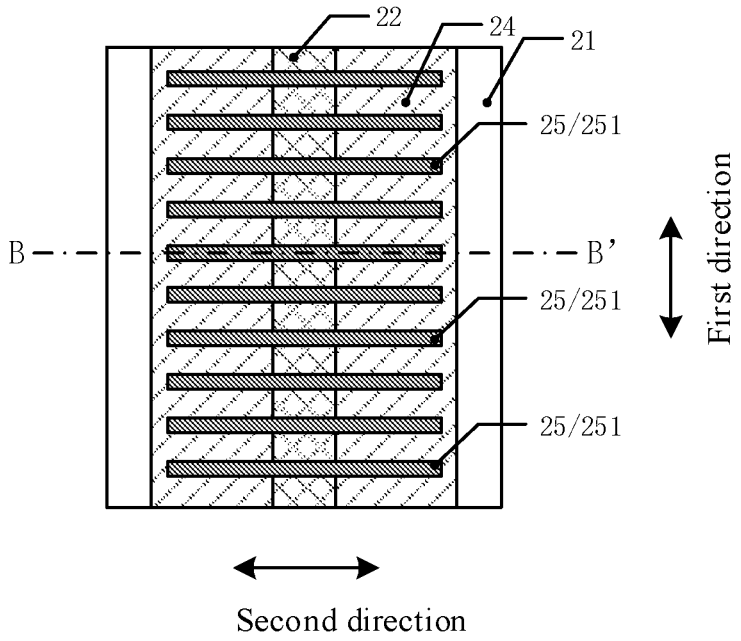
FIG. 3 shows a top view of a structure of a phase shifter according to some embodiments of the present disclosure.
Figure 4:
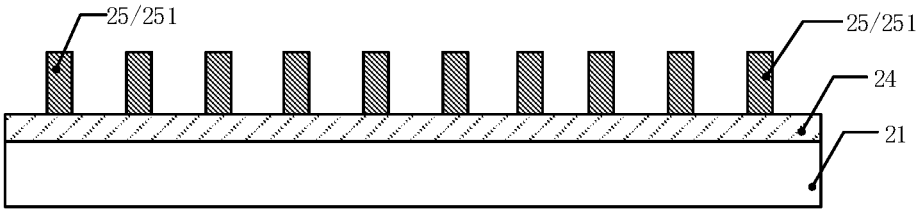
FIG. 4 shows a side view of a structure of a phase shifter according to some embodiments of the present disclosure.
Figure 5:
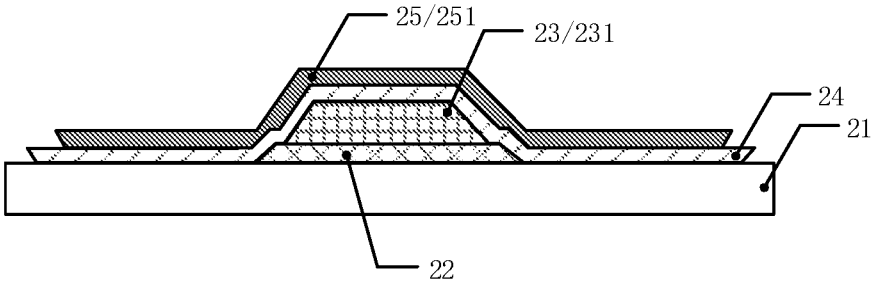
FIG. 5 shows a cross-sectional view of a structure of a phase shifter according to some embodiments of the present disclosure.

FIGS. 3-5 show a structure of a phase shifter according to some embodiments of the present disclosure, FIG. 3 is a top view of the structure of the phase shifter, FIG. 4 is a side view of the structure of the phase shifter, and FIG. 5 is a cross-sectional view of the phase shifter along a line B-B' in FIG. 3.

Referring to FIGS. 3-5, the phase shifter may include a dielectric substrate 21 and a transmission line 22 (FIGS. 3 and 5), a dielectric layer 23 (FIG. 5), an insulating layer 24, and a metal layer 25, which are disposed with respect to the dielectric substrate 21. In a direction perpendicular to the first surface of the dielectric substrate 21, the dielectric layer 23 and the insulating layer 24 may be disposed between the metal layer 25 and the transmission line 22. A material of the dielectric layer 23 may be a semiconductor material. The metal layer 25 includes a plurality of metal blocks 251 spaced apart from each other. On the first surface of the dielectric substrate 21, the plurality of metal blocks 251 are arranged along a first direction (FIG. 3), an extension direction of the transmission line 22 is the first direction.

In some embodiments, in the direction perpendicular to the first surface of the dielectric substrate 21, the dielectric layer 23 may be disposed between the insulating layer 24 and the transmission line 22, and the insulating layer 24 may be disposed between the dielectric layer 23 and the metal layer 25.

In some embodiments, in the first direction, a distance between any two adjacent metal blocks 251 in the plurality of metal blocks 251 is a fixed value. For example, the distance may be 1/40 of the wavelength of the signal transmitted by the transmission line 22.

In some embodiments, in the first direction, the distances between any two adjacent metal blocks 251 in the plurality of metal blocks 251 are different. For example, the distance between any two adjacent metal blocks 251 in the plurality of metal blocks 251 is set according to a predetermined rule.

In some embodiments, the widths of the plurality of metal blocks 251 in the first direction are the same. For example, the width may be 1/100 of the wavelength of the signal transmitted by the transmission line 22.

In some embodiments, the widths of the plurality of metal blocks 251 in the first direction are different. For example, the widths of the plurality of metal blocks 251 in the first direction may be set according to a predetermined rule.

For example, an extension direction of the plurality of metal blocks 251 is a second direction (FIG. 3), and the second direction and the first direction are perpendicular to each other.

For example, the plurality of metal blocks 251 have the same shape, for example, the shape is a rectangle. However, the present disclosure is not limited to this, and the shape of the metal block can be set according to actual application requirements.

For example, the material of the plurality of metal blocks 251 may include copper, silver, iron, aluminum, iron, and the like.

In some embodiments, the dielectric layer 23 includes a plurality of dielectric sub-layers 231 (FIG. 5), which are in one-to-one correspondence with the plurality of metal blocks, the plurality of dielectric sub-layers 231 are spaced apart from each other, and the insulating layer 24 covers the plurality of dielectric sub-layers 231 and further covers gaps between the plurality of dielectric sub-layers 231 to insulate the plurality of dielectric sub-layers 231 from each other.

In some embodiments, the orthographic projection of each of the plurality of metal blocks on the dielectric substrate 21 covers at least an orthographic projection of a corresponding dielectric sub-layer 231 of the plurality of dielectric sub-layers 231 on the dielectric substrate 21. For example, each dielectric sub-layer 231, the metal block 251 corresponding to the dielectric sub-layer 231, the insulating layer 24, and the transmission line 22 constitute an equivalent capacitor, that is, the amount of equivalent capacitors included in the phase shifter is the same as the amount of the dielectric sub-layers 231.

In some embodiments, the phase shifter further includes a voltage control module, and the voltage control module is configured to control a first voltage applied to the transmission line 22 and a second voltage applied to the metal layer 25, and the capacitance value of the equivalent capacitor can be adjusted by controlling the amplitudes (i.e., magnitudes) of the first voltage and the second voltage. For example, the voltage control module may include a voltage generator and a controller, the controller may receive an indication signal and generate a control signal based on the indication signal, and the voltage generator is configured to generate the first voltage applied to the transmission line 22 and the second voltage applied to the metal layer 25 under the control of the control signal generated by the controller. For example, the indication signal can be sent by the user in real time, or the indication signal can be a preset signal.

For example, in some embodiments, the plurality of metal blocks 251 are connected to the same signal line to receive the second voltage generated by the voltage generator. For example, in other embodiments, the metal blocks 251 are connected to different signal lines, respectively, and the different signal lines all transmit the same second voltage. The present disclosure is not limited to this case, and in this embodiment, the plurality of metal blocks 251 may be applied with different voltages, respectively.

With regard to the configuration of the transmission line 22, the insulating layer 24, and the dielectric layer 23, reference can be made to the previous description, and detailed description will be omitted here.

Figure 6:
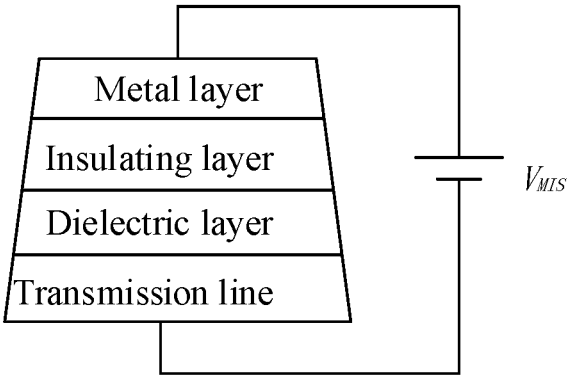
FIG. 6 shows a schematic diagram of applying a bias voltage to a phase shifter according to some embodiments of the present disclosure.
Figure 7:
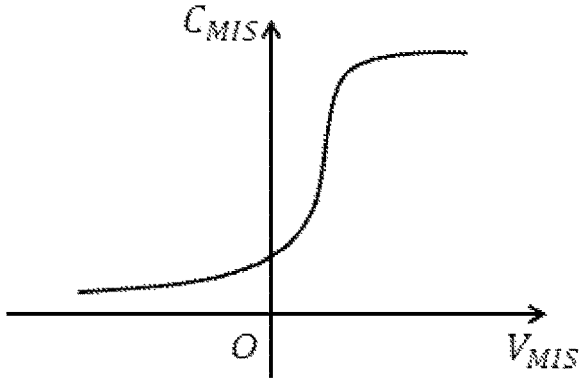
FIG. 7 is a curve diagram showing a relationship between a capacitance value of an equivalent capacitor formed by a metal layer, an insulating layer, a dielectric layer and a transmission line in a phase shifter according to some embodiments of the present disclosure and an applied bias voltage.

FIG. 6 shows a schematic diagram of applying a bias voltage to a phase shifter according to some embodiments of the present disclosure. FIG. 7 is a schematic diagram showing a relationship between a capacitance value $C_{MIS}$ of an equivalent capacitor formed by a metal layer, an insulating layer, a dielectric layer and a transmission line in a phase shifter according to some embodiments of the present disclosure and an applied bias voltage $V_{MIS}$.

Referring to FIG. 6, the metal layer, the insulating layer, the dielectric layer, and the transmission line of the phase shifter constitute an equivalent capacitor (i.e., MIS capacitor). By applying the first voltage to the transmission line and applying the second voltage to the metal layer, a bias voltage $V_{MIS}$ indicating a difference between the first voltage and the second voltage may be applied between the transmission line and the metal layer. For example, a magnitude and direction of the bias voltage $V_{MIS}$ can be changed by adjusting the first voltage and the second voltage through the voltage control module. For example, in the embodiment of the present disclosure, the operating frequency band of the signal transmitted in the transmission line is different from the operating frequency band of the first voltage applied to the transmission line, and the signal transmitted in the transmission line and the first voltage applied to the transmission line can be transmitted independently of each other.

The following description will take the example that the material of the dielectric layer is an a-Si material. Because there are many free electrons in the a-Si material, the dielectric layer is equivalent to an N-type semiconductor. In the case where $V_{MIS}>0$ (that is, the first voltage is greater than the second voltage, and the bias voltage $V_{MIS}$ is a forward voltage), there is an electric field from top to bottom (that is, from the metal layer to the transmission line), so that the surface of the dielectric layer close to the metal layer is full of positive charges, thus forming a depletion layer on the surface. In this case, the capacitance value of each equivalent capacitor is a value obtained by connecting the equivalent capacitance value of the insulating layer and the equivalent capacitance value of the depletion layer in series. In the case where $V_{MIS}>0$ (that is, the first voltage is less than the second voltage, and the bias voltage $V_{MIS}$ is a reverse voltage, for example, FIG. 6 shows a case where the bias voltage $V_{MIS}$ is a reverse voltage), electrons in the metal layer and the dielectric layer can move freely, and the metal layer and the dielectric layer correspond to good conductors. In this case, the capacitance value of each equivalent capacitor is equal to the equivalent capacitance value of the insulating layer.

In an embodiment of the present disclosure, the capacitance value of the equivalent capacitor is adjustable. For example, referring to FIG. 7, in the case where the bias voltage $V_{MIS}$ is a forward voltage with respect to each equivalent capacitor, that is, $V_{MIS}>0$, the capacitance value $C_{MIS}$ of each equivalent capacitor increases as an absolute value of the magnitude of the bias voltage $V_{MIS}$ increases, and remains unchanged upon increasing to a first specific value; in the case where the bias voltage $V_{MIS}$ is a reverse voltage relative to each equivalent capacitor, that is, $V_{MIS}<0$, the capacitance value of each equivalent capacitor decreases as the absolute value of the magnitude of the bias voltage $V_{MIS}$ increases, and remains unchanged upon decreasing to a second specific value. For example, the first specific value and the second specific value are related to parameters, such as doping characteristics and thickness of the dielectric in the dielectric layer.

Figure 8:
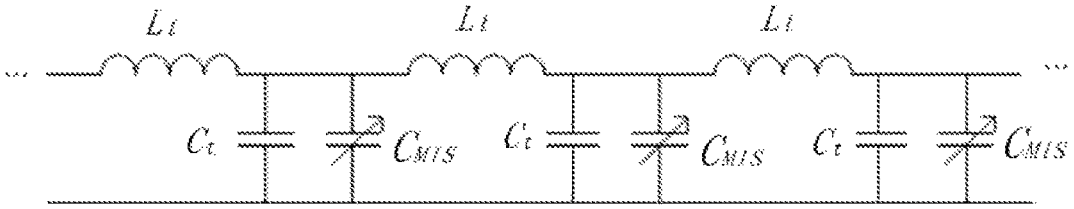
FIG. 8 shows an equivalent circuit model in a case where a bias voltage is applied to the phase shifter described with reference to FIGS. 3 to 5.

FIG. 8 shows an equivalent circuit model in the case where a bias voltage is applied to the phase shifter described with reference to FIGS. 3-5.

Referring to FIG. 8, Lt and Ct represent an equivalent inductance and an equivalent capacitance of the transmission line 22, respectively, and $C_{MIS}$ represents the equivalent capacitor, that is, the adjustable capacitor brought about by the introduction of the semiconductor dielectric layer 23. b represents a distance between adjacent metal blocks among the plurality of metal blocks 251 in the first direction. The phase velocity $v_p$ of the signal transmitted by the transmission line 22 can be expressed by the following formula:

$$v_p=1/\sqrt{bL_0(bC_0+C_1)}$$

$$v_p = \frac{1}{\sqrt{bL_0(bC_0 + C_1)}}$$

In the above formula, $v_p$ represents the phase velocity, $L_0$ and $C_0$ respectively represent the inductance value of the equivalent inductance Lt and the capacitance value of the equivalent capacitance Ct of the transmission line 22, and $C_1$ represents the capacitance value of the equivalent capacitor $C_{MIS}$. The inductance value $L_0$ of the equivalent inductance Lt and the capacitance value $C_0$ of the equivalent capacitance $C_t$ of the transmission line 22 are related to the structure and size of the transmission line 22, and the capacitance value $C_1$ of the equivalent capacitor $C_{MIS}$ is related to the structure and size of the dielectric layer 23 and the bias voltage. Therefore, by adjusting the capacitance value $C_1$ of the equivalent capacitor $C_{MIS}$, the phase velocity can be adjusted, thus changing a phase shift angle. With reference to the description of FIGS. 6 and 7, by adjusting the bias voltage $V_{MIS}$, the capacitance value $C_1$ of the equivalent capacitor $C_{MIS}$ can be adjusted, thereby adjusting the phase velocity of the signal transmitted by the transmission line 22.

In addition, according to the formula of the parallel plate capacitor, the capacitance value $C_1$ of the equivalent capacitor $C_{MIS}$ can be expressed as:

$$C_1 = \frac{\varepsilon_0 \varepsilon_r S}{d}$$

In the above formula, d is an equivalent distance of the equivalent capacitor, $\varepsilon_r$ is a relative dielectric constant, $\varepsilon_0$ is a vacuum dielectric constant, and S is an equivalent area of the equivalent capacitor. For example, the equivalent distance is related to the thickness of the dielectric layer 23. In some cases, due to uneven charge distribution in the dielectric layer 23, the equivalent distance is generally less than the thickness of the dielectric layer 23. For example, the equivalent area is the overlapping area between the orthographic projection of the metal block 251 corresponding to the equivalent capacitor on the dielectric substrate 21 and the orthographic projection of the dielectric sub-layer 231 corresponding to the equivalent capacitor on the dielectric substrate 21. It can be seen from the above formula that the capacitance value $C_1$ of the equivalent capacitor $C_{MIS}$ is proportional to the relative dielectric constant and inversely proportional to the equivalent distance.

For the liquid crystal phase shifter, the relative dielectric constant of the formed equivalent capacitor is generally 2.58~3.6, and the thickness of the liquid crystal cell (that is, the equivalent distance of the equivalent capacitor) is generally greater than 5 microns. In the phase shifter according to some embodiments of the present disclosure, in a case where gallium arsenide (GaAs) is used as the material of the dielectric layer, the relative dielectric constant of the equivalent capacitor may be 13.18, and the equivalent distance of the equivalent capacitor is about 0.1 to 1 micron. Therefore, without applying a bias voltage, the equivalent capacitance value of the equivalent capacitor in the phase shifter according to some embodiments of the present disclosure may be 18 times larger than the equivalent capacitance value of the liquid crystal phase shifter. Therefore, compared with the liquid crystal phase shifter, the phase shifter according to some embodiments of the present disclosure can obtain a wider adjustment range of the equivalent capacitance value, thereby obtaining a wider adjustment range of the phase velocity. In addition, because the phase shifter according to the embodiment of the present disclosure adjusts the capacitance value of the equivalent capacitor by adjusting the distribution of charges in the dielectric layer, the response speed of the phase shifter according to the embodiment of the present disclosure is faster than that of the liquid crystal phase shifter.

It should be noted that although the corresponding equivalent circuit models are described based on the embodiments of the phase shifters corresponding to FIGS. 3-5, this is only convenient for those skilled in the art to understand the present disclosure, and should not be understood as limiting the scope of the present disclosure. For example, the embodiments corresponding to FIGS. 1 and 2 have similar equivalent circuit models. Therefore, for the embodiments described with reference to FIGS. 1 and 2, by adjusting the bias voltage $V_{MIS}$, the phase velocity of the signal transmitted by the transmission line can be changed.

Figure 9:
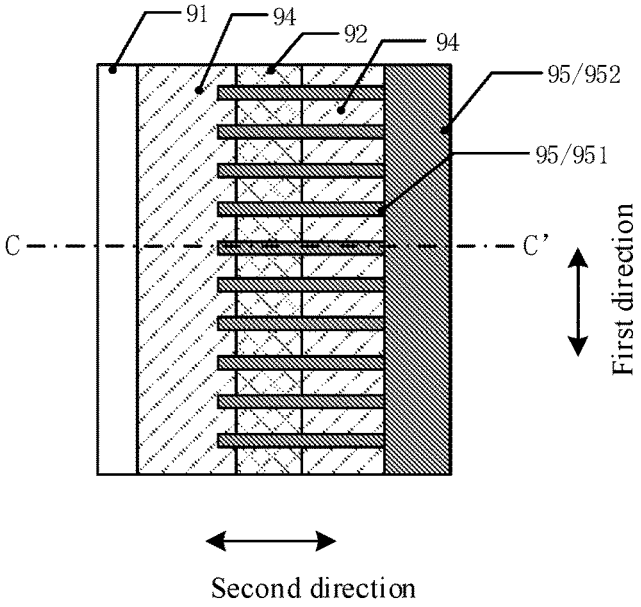
FIG. 9 shows a top view of a structure of a phase shifter according to some embodiments of the present disclosure.
Figure 10:
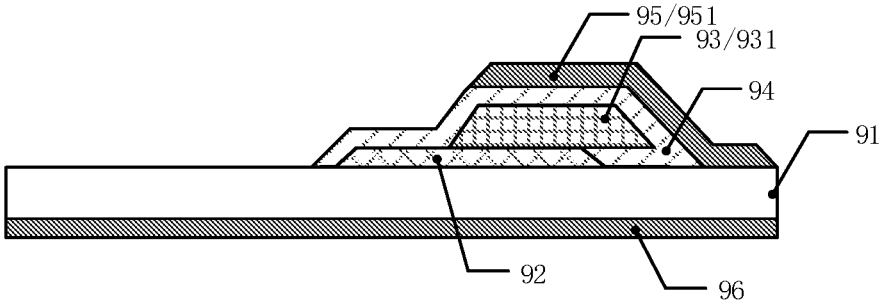
FIG. 10 shows a cross-sectional view of a structure of a phase shifter according to some embodiments of the present disclosure.
Figure 11:
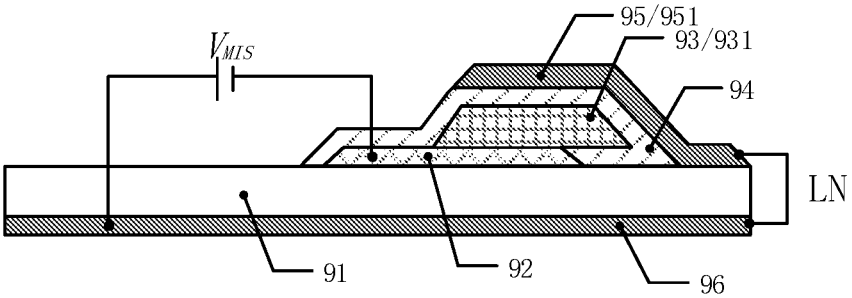
FIG. 11 shows a schematic diagram of applying a bias voltage to a phase shifter according to some embodiments of the present disclosure.

Next, the structure of the phase shifter and the method of applying the bias voltage in the case where the transmission line is implemented as a microstrip line according to some embodiments of the present disclosure will be described with reference to FIGS. 9-11. FIG. 9 shows a top view of the structure of a phase shifter according to some embodiments of the present disclosure. FIG. 10 shows a cross-sectional view of a phase shifter along line C-C' in FIG. 9 according to some embodiments of the present disclosure. FIG. 11 shows a schematic diagram of applying a bias voltage to a phase shifter according to some embodiments of the present disclosure.

Referring to FIGS. 9 and 10, the phase shifter may include a dielectric substrate 91, a connection layer, a transmission line 92, a dielectric layer 93 (FIG. 10), an insulating layer 94, and a metal layer 95, the transmission line 92, the dielectric layer 93, the insulating layer 94, and the metal layer 95 are disposed on the dielectric substrate 91. In a direction perpendicular to the first surface of the dielectric substrate 91, the dielectric layer 93 and the insulating layer 94 may be disposed between the metal layer 95 and the transmission line 92. A material of the dielectric layer 93 may be a semiconductor material. An orthographic projection of the metal layer 95 on the dielectric substrate 91, an orthographic projection of the insulating layer 94 on the dielectric substrate 91, and an orthographic projection of the dielectric layer 93 on the dielectric substrate 91 at least partially overlap. The connection layer is electrically connected to the metal layer 95.

The metal layer 95 includes a plurality of metal blocks 951 spaced apart from each other. On the first surface of the dielectric substrate 91, the plurality of metal blocks 951 are arranged along the first direction. It should be noted that the description of the metal block 951 can refer to the description of the metal block in the above embodiment, and will not be repeated here.

In some embodiments, as shown in FIG. 9, the metal layer 95 includes a connection sub-layer 952 configured to electrically connect the plurality of metal blocks 951. The plurality of metal blocks 951 in the metal layer 95 are electrically connected together through the connection sub-layer 952.

For example, the connection layer includes a ground layer 96 (FIGS. 10 and 11) disposed on a second surface of the dielectric substrate 91 away from the first surface, and the ground layer 96 is configured to be grounded. For example, the first surface may be an upper surface of the dielectric substrate 91, and the second surface may be a lower surface of the dielectric substrate 91. Thus, the ground layer 96 and the transmission line 92 form a microstrip line. Compared with the metal wave-guide, the microstrip line has the advantages of small size, light weight, wide bandwidth, high reliability, low manufacturing cost, etc.

In some embodiments, as shown in FIG. 11, the phase shifter may further include a connection line LN, and the connection line LN is configured for electrically connecting the ground layer 96 and the metal layer 95. For example, the connection line LN may be independent of at least one of the connection layer and the metal layer 95. For example, the ground layer 96 may be provided with a first connection terminal, the metal layer 95 may be provided with a second connection terminal, and the connection line LN is electrically connected to the first connection terminal and the second connection terminal, respectively. For example, the connection line LN may be a metal line. The metal layer 95 is also grounded by electrically connecting the ground layer 96 with the metal layer 95 using the connection line LN. In an embodiment where the metal layer 95 includes the connection sub-layer 952, the connection line LN is used to electrically connect the connection sub-layer 952 and the ground layer 96. It is also achieved that the metal layer 95 is grounded by electrically connecting the connection sub-layer 952 with the ground layer 96 using the connection line LN.

In some embodiments, in the direction perpendicular to the first surface of the dielectric substrate 91, the dielectric layer 93 may be disposed between the insulating layer 94 and the transmission line 92, and the insulating layer 94 may be disposed between the dielectric layer 93 and the metal layer 95.

In some embodiments, the dielectric layer 93 includes a plurality of dielectric sub-layers 931 (FIGS. 10 and 11), which are in one-to-one correspondence with the plurality of metal blocks, the plurality of dielectric sub-layers 931 are spaced apart from each other, and the insulating layer 94 covers the plurality of dielectric sub-layers 931 and further covers gaps between the plurality of dielectric sub-layers 931.

In some embodiments, an orthographic projection of each of the plurality of metal blocks 951 on the dielectric substrate 91 covers at least an orthographic projection of a corresponding dielectric sub-layer 931 of the plurality of dielectric sub-layers 931 on the dielectric substrate 91.

In some embodiments, the phase shifter further includes a voltage control module configured to control a first voltage applied to the transmission line 92 and a second voltage applied to the metal layer 95, and the capacitance value of the equivalent capacitor can be adjusted by controlling the amplitudes (i.e., magnitudes) of the first voltage and the second voltage. For example, the voltage control module may include a voltage generator and a controller, the controller may receive an indication signal and generate a control signal based on the indication signal, and the voltage generator is configured to generate the first voltage applied to the transmission line 92 and the second voltage applied to the metal layer 95 under the control of the control signal generated by the controller. For example, the indication signal can be sent by the user in real time, or the indication signal can be a preset signal.

For example, in some embodiments, the plurality of metal blocks 951 are connected to the same signal line to receive the second voltage generated by the voltage generator. For example, in other embodiments, the plurality of metal blocks 951 are respectively connected to different signal lines, and the different signal lines all transmit the same second voltage. For example, in an embodiment where the metal layer 95 includes a connection sub-layer 952 (FIG. 9), the connection sub-layer 952 is connected to the signal line, such that the metal layer 95 receives the second voltage generated by the voltage generator.

Referring to FIG. 11, by applying the first voltage to the transmission line 92 and the second voltage to the ground layer 96, a bias voltage $V_{MIS}$ indicating a difference between the first voltage and the second voltage may be applied between the transmission line 92 and the metal layer 95. The capacitance value of the equivalent capacitor formed by the metal layer 95, the insulating layer 94, the dielectric layer 93, and the transmission line 92 is adjusted by changing the bias voltage $V_{MIS}$. Furthermore, the phase velocity can be adjusted by adjusting the capacitance value, thus changing the phase shift angle. For example, in the embodiment shown in FIG. 11, the ground layer 96 can be grounded, so that the first voltage is a fixed value, for example, 0 volts (that is, the voltage of a ground terminal), and in this case, the bias voltage $V_{MIS}$ can only be adjusted by the value of the second voltage.

Figure 12:
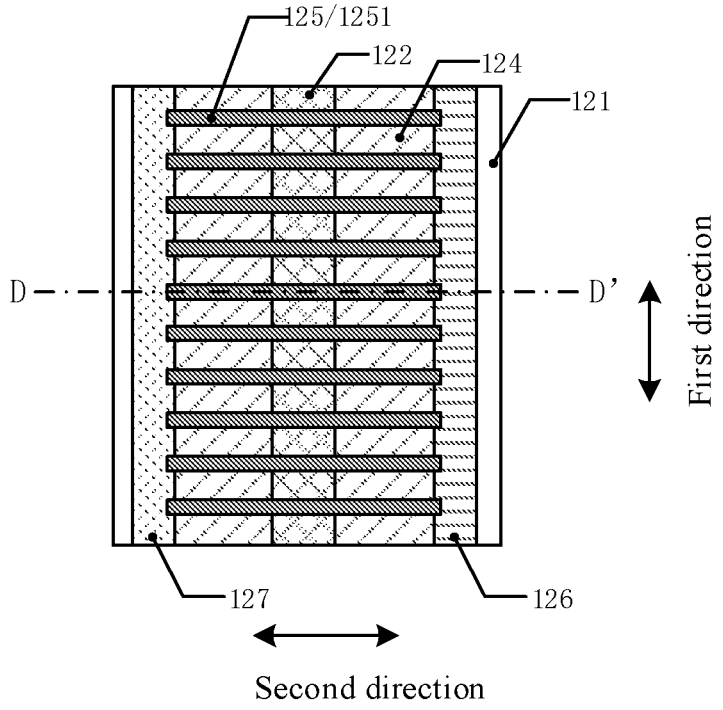
FIG. 12 shows a top view of a structure of a phase shifter according to some embodiments of the present disclosure.
Figure 13:
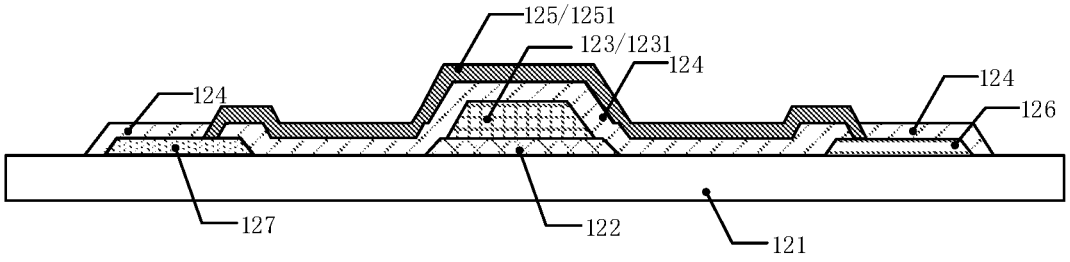
FIG. 13 shows a cross-sectional view of a structure of a phase shifter according to some embodiments of the present disclosure.
Figure 14:
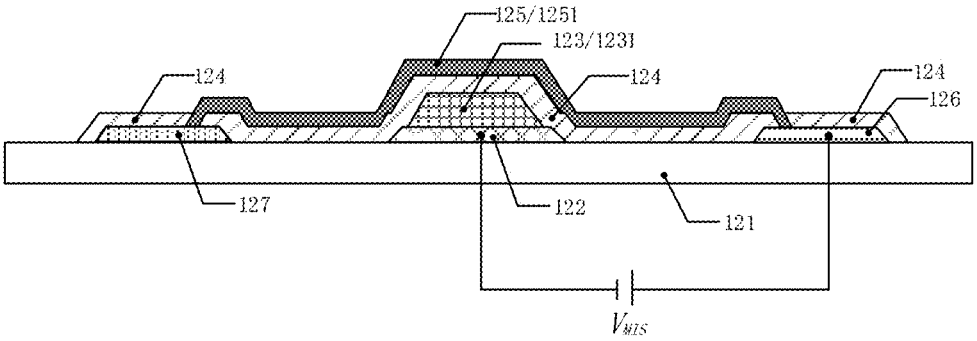
FIG. 14 shows a schematic diagram of applying a bias voltage to a phase shifter according to some embodiments of the present disclosure.

The following will describe the structure of the phase shifter and the method of applying the bias voltage in the case where the transmission line is implemented as a coplanar wave-guide according to some embodiments of the present disclosure. FIG. 12 shows a top view of the structure of a phase shifter according to some embodiments of the present disclosure. FIG. 13 shows a cross-sectional view of a phase shifter along line D-D' in FIG. 12 according to some embodiments of the present disclosure. FIG. 14 shows a schematic diagram of applying a bias voltage to a phase shifter according to some embodiments of the present disclosure.

Referring to FIGS. 12 and 13, the phase shifter may include a dielectric substrate 121, a connection layer, and a transmission line 122, a dielectric layer 123 (FIG. 13), an insulating layer 124, and a metal layer 125, the transmission line 122, the dielectric layer 123, the insulating layer 124, and the metal layer 125 are disposed with respect to the dielectric substrate 121. In a direction perpendicular to a first surface of the dielectric substrate 121, the dielectric layer 123 and the insulating layer 124 may be disposed between the metal layer 125 and the transmission line 122. A material of the dielectric layer 123 may be a semiconductor material. An orthographic projection of the metal layer 125 on the dielectric substrate 121, an orthographic projection of the insulating layer 124 on the dielectric substrate 121, and an orthographic projection of the dielectric layer 123 on the dielectric substrate 121 at least partially overlap.

The metal layer 125 includes a plurality of metal blocks 1251 spaced apart from each other. On the first surface of the dielectric substrate 121, the plurality of metal blocks 1251 are arranged along the first direction, and an extension direction of the transmission line 122 is the first direction. The connection layer includes a first conductor portion 126 electrically connected to the metal layer 125, the first conductor portion 126 is disposed on the first surface of the dielectric substrate 121, and the first conductor portion 126 and the transmission line 122 are spaced apart from each other. For example, the first conductor portion 126 and the transmission line 122 are formed in the same layer. Accordingly, the first conductor portion 126 and the transmission line 122 form a coplanar wave-guide. Because the transmission line 122 as a center conductor and the first conductor portion 126 are located in the same plane, it is convenient to mount components in parallel on the coplanar wave-guide, and a monolithic microwave integrated circuit with the transmission line 122 and components on the same side can be formed.

In some embodiments, the first conductor portion 126 is in contact with the metal layer 125. For example, the insulating layer may include a plurality of first via holes, the first conductor portion 126 is connected to the metal layer 12 through the plurality of first via holes. For example, the plurality of first via holes are in one-to-one correspondence with the plurality of metal blocks 1251. For example, the first conductor portion 126 may be connected to the metal layer 125 by a coating process. Therefore, in the embodiment of the present disclosure, grounding the metal layer 125 by means, such as welding, can be avoided, and the process complexity of grounding is reduced.

In some embodiments, the first conductor portion 126 and the transmission line 122 are parallel to each other. That is, on the first surface of the dielectric substrate 121, the extension direction of the first conductor portion 126 may also be the first direction (FIG. 12).

For example, the shape of the orthographic projection of the first conductor portion 126 on the dielectric substrate 121 is a rectangle.

In some embodiments, the connection layer further includes a second conductor portion 127 disposed on the first surface of the dielectric substrate 121, and the first conductor portion 126, the second conductor portion 127, and the transmission line 122 are all spaced apart from each other. For example, the first conductor portion 126, the second conductor portion 127, and the transmission line 122 are parallel to each other. That is, on the first surface of the dielectric substrate 121, the extension direction of the second conductor portion 127 may also be the first direction. Therefore, on the first surface of the dielectric substrate 121, the extension direction of the transmission line 122, the extension direction of the first conductor portion 126, and the extension direction of the second conductor portion 127 are all the first directions. For example, the first conductor portion 126, the second conductor portion 126, and the transmission line 122 are formed in the same layer. Accordingly, the first conductor portion 126, the second conductor portion 126, and the transmission line 122 form a coplanar wave-guide.

For example, the shape of the orthographic projection of the second conductor portion 127 on the dielectric substrate 121 is a rectangle.

In some embodiments, the transmission line 122, the first conductor portion 126, and the second conductor portion 127 are arranged along the second direction (FIG. 12), and the transmission line 122 is located between the first conductor portion 126 and the second conductor portion 127 in the second direction. For example, the second direction may be a direction perpendicular to the first direction on the first surface of the dielectric substrate 121. For example, the first conductor portion 126 and the second conductor portion 127 may be arranged in close proximity to the transmission line 122.

In some embodiments, in the direction perpendicular to the first surface of the dielectric substrate 121, the dielectric layer 123 may be disposed between the insulating layer 124 and the transmission line 122, and the insulating layer 124 may be disposed between the dielectric layer 123 and the metal layer 125.

In some embodiments, the distance between any two adjacent metal blocks 1251 in the plurality of metal blocks 1251 may be a fixed value.

In some embodiments, the widths of the plurality of metal blocks 1251 in the first direction are the same.

For example, the extension direction of the plurality of metal blocks 1251 is the second direction, and the second direction and the first direction are perpendicular to each other.

For example, the plurality of metal blocks 1251 have the same shape, for example, the plurality of metal blocks 1251 are all rectangular. However, the present disclosure is not limited to this case, and the shape of the metal block 1251 can be set according to actual application requirements.

It should be noted that the description of the metal block 1251 can refer to the description of the metal block in the above embodiment, and will not be repeated here.

In some embodiments, the dielectric layer 123 includes a plurality of dielectric sub-layers 1231 (FIGS. 13 and 14), which are in one-to-one correspondence with the plurality of metal blocks 1251, the plurality of dielectric sub-layers 1231 are spaced apart from each other, and the insulating layer 124 covers the plurality of dielectric sub-layers 1231 and further covers gaps between the plurality of dielectric sub-layers 1231 to insulate the plurality of dielectric sub-layers 1231 from each other.

In some embodiments, an orthographic projection of each of the plurality of metal blocks 1251 on the dielectric substrate 121 covers at least an orthographic projection of a corresponding dielectric sub-layer 1231 of the plurality of dielectric sub-layers 1231 on the dielectric substrate 121. For example, each dielectric sub-layer, the metal block 1251 corresponding to the dielectric sub-layer 1231, the insulating layer 124, and the transmission line 122 constitute an equivalent capacitor, that is, the amount of equivalent capacitors included in the phase shifter is the same as the amount of the dielectric sub-layers 1231.

In some embodiments, the phase shifter may further include a voltage control module, and the voltage control module may be configured to control the first voltage applied to the transmission line 122 and the second voltage applied to the metal layer 125, and the capacitance value of the equivalent capacitor may be adjusted by controlling the amplitudes (i.e., magnitudes) of the first voltage and the second voltage. For example, the voltage control module may include a voltage generator and a controller, the controller may receive an indication signal and generate a control signal based on the indication signal, and the voltage generator may be configured to generate the first voltage applied to the transmission line 122 and the second voltage applied to the metal layer 125 under the control of the control signal generated by the controller. For example, the indication signal can be sent by the user in real time, or the indication signal can be a preset signal.

For example, in some embodiments, the plurality of metal blocks 1251 are connected to the same signal line to receive the second voltage generated by the voltage generator. For example, in other embodiments, the metal blocks 1251 are connected to different signal lines, respectively, and the different signal lines all transmit the same second voltage. The present disclosure is not limited to this case, and in this embodiment, the plurality of metal blocks 1251 may also be respectively applied with different voltages.

Referring to FIG. 14, by applying the first voltage to the transmission line 122 and the second voltage to one of the first conductor portion 126 and the second conductor portion 127 (FIG. 14 shows the case where the second voltage is applied to the first conductor portion 126), a bias voltage $V_{MIS}$ indicating a difference between the first voltage and the second voltage can be applied between the transmission line 122 and the metal layer 125. The capacitance value of the equivalent capacitor formed by the metal layer 125, the insulating layer 124, the dielectric layer 123, and the transmission line 122 is adjusted by changing the bias voltage $V_{MIS}$. Furthermore, the phase velocity can be adjusted by adjusting the capacitance value, thus changing the phase shift angle.

It should be noted that, in the embodiment of the present disclosure, the "extension direction" refers to the extension direction of a longer geometric center line of the pattern outline of the element. For example, in the case where the element is a rectangle, the "extension direction of the rectangle" may refer to the direction parallel to a long edge of the rectangle.

Figure 15:
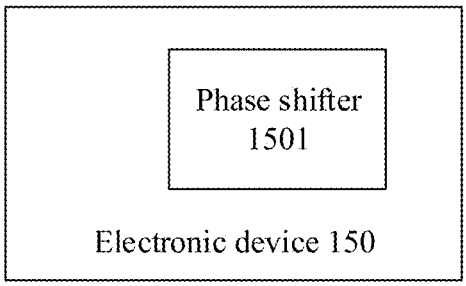
FIG. 15 shows a block diagram of an electronic device according to some embodiments of the present disclosure.

FIG. 15 shows a block diagram of an electronic device according to some embodiments of the present disclosure.

Referring to FIG. 15, an electronic device 150 may include a phase shifter 1501. For example, the phase shifter 1501 can be any one phase shifter in the above-described embodiments.

For example, the electronic devices 150 in embodiments of the present disclosure may include devices, such as smart phones, tablet personal computers (PCs), radar devices, servers, mobile phones, video phones, e-book readers, desktop PCs, laptop computers, netbook computers, personal digital assistants (PDA), portable multimedia players (PMP), MP3 players, mobile medical devices, cameras or wearable devices (e.g., head-mounted devices (HMD), electronic clothes, electronic bracelets, electronic necklaces, electronic accessories, electronic tattoos, or smart watches), etc.

Figure 16:
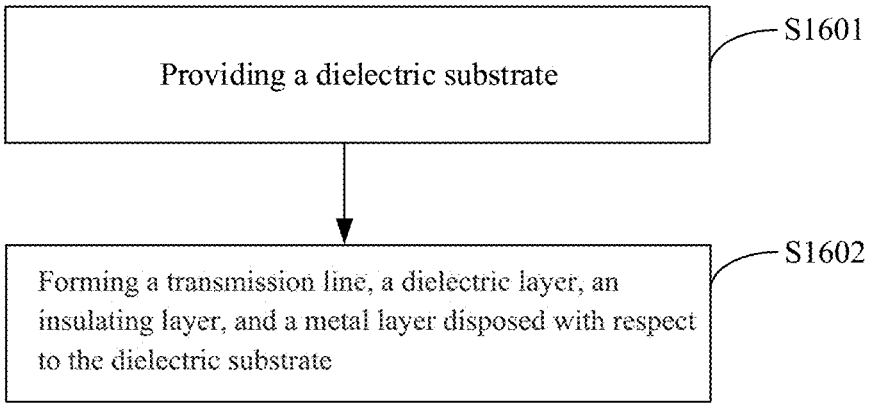
FIG. 16 shows a flowchart of a manufacture method for manufacturing a phase shifter according to some embodiments of the present disclosure.

FIG. 16 shows a flowchart of a manufacture method for manufacturing a phase shifter according to some embodiments of the present disclosure.

Referring to FIG. 16, the manufacturing method for manufacturing the phase shifter may include step S1601 and step S1602.

At step S1601, providing a dielectric substrate.

At step S1602, forming a transmission line, a dielectric layer, an insulating layer, and a metal layer disposed with respect to the dielectric substrate. In a direction perpendicular to a first surface of the dielectric substrate, the dielectric layer and the insulating layer are disposed between the metal layer and the transmission line, and the material of the dielectric layer is a semiconductor material. An orthographic projection of the metal layer on the dielectric substrate, an orthographic projection of the insulating layer on the dielectric substrate, and an orthographic projection of the dielectric layer on the dielectric substrate at least partially overlap.

In some embodiments, forming the transmission line, the dielectric layer, the insulating layer, and a metal layer on the dielectric substrate, comprises: forming the transmission line on the first surface of the dielectric substrate; forming the dielectric layer on a side of the transmission line away from the dielectric substrate; forming the insulating layer on the dielectric substrate on which the dielectric layer is formed, the insulating layer being formed on a side of the dielectric layer away from the dielectric substrate; and forming the metal layer on a side of the insulating layer away from the dielectric substrate.

Figure 17:
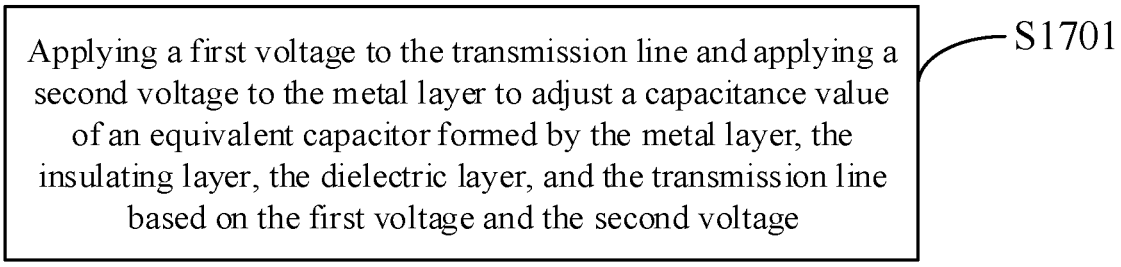
FIG. 17 shows a flowchart of a drive method for driving a phase shifter according to some embodiments of the present disclosure.

FIG. 17 shows a flowchart of a drive method for driving a phase shifter according to some embodiments of the present disclosure.

Referring to FIG. 17, the drive method for driving the phase shifter may include step S1701.

At step S1701, applying a first voltage to the transmission line and applying a second voltage to the metal layer to adjust a capacitance value of an equivalent capacitor formed by the metal layer, the insulating layer, the dielectric layer, and the transmission line based on the first voltage and the second voltage.

In some embodiments, step S1701 includes at least one of the following:

controlling the first voltage to be greater than the second voltage, so that the capacitance value increases as an absolute value of a voltage difference between the first voltage and the second voltage increases, where the capacitance value remains unchanged upon increasing to a first specific value; and/or controlling the first voltage to be less than the second voltage, so that the capacitance value decreases as the absolute value of the voltage difference between the first voltage and the second voltage increases, where the capacitance value remains unchanged upon decreasing to a second specific value.

For example, controlling the first voltage to be greater than the second voltage may include: controlling the first voltage to remain unchanged and decreasing the second voltage so that the first voltage is greater than the second voltage; or, controlling the second voltage to remain unchanged and increasing the first voltage; or, increasing the first voltage while decreasing the second voltage.

For example, controlling the first voltage to be less than the second voltage may include: controlling the first voltage to remain unchanged and increasing the second voltage so that the first voltage is less than the second voltage; or, control the second voltage to remain unchanged and decreasing the first voltage; or, decreasing the first voltage while increasing the second voltage.

It should be noted that the description of the change of the capacitance value of the equivalent capacitor with the voltage difference between the first voltage and the second voltage can refer to the relevant description in the embodiments of the above-mentioned phase shifter.

What have been described above are only exemplary implementations of the present disclosure, and are not used to limit the protection scope of the present disclosure, and the protection scope of the present disclosure should be based on the protection scope of the claims.

What is claimed is:

1. A manufacture method for manufacturing a phase shifter, comprising:

providing a dielectric substrate; and forming a transmission line, a dielectric layer, an insulating layer, and a metal layer disposed with respect to the dielectric substrate, wherein in a direction perpendicular to a first surface of the dielectric substrate, the dielectric layer and the insulating layer are between the metal layer and the transmission line, a material of the dielectric layer is a semiconductor material, and an orthographic projection of the metal layer on the dielectric substrate, an orthographic projection of the insulating layer on the dielectric substrate, and an orthographic projection of the dielectric layer on the dielectric substrate at least partially overlap;

wherein forming the transmission line, the dielectric layer, the insulating layer, and the metal layer disposed with respect to the dielectric substrate, comprises:

forming the transmission line on the first surface of the dielectric substrate;

forming the dielectric layer on a side of the transmission line away from the dielectric substrate;

forming the insulating layer on the dielectric substrate on which the dielectric layer is formed, wherein the insulating layer is formed on a side of the dielectric layer away from the dielectric substrate; and forming the metal layer on a side of the insulating layer away from the dielectric substrate.

2. A phase shifter, comprising a dielectric substrate, and a transmission line, a dielectric layer, an insulating layer, and a metal layer disposed with respect to the dielectric substrate, wherein in a direction perpendicular to a first surface of the dielectric substrate, the dielectric layer and the insulating layer are between the metal layer and the transmission line, and a material of the dielectric layer is a semiconductor material; and an orthographic projection of the metal layer on the dielectric substrate, an orthographic projection of the insulating layer on the dielectric substrate, and an orthographic projection of the dielectric layer on the dielectric substrate at least partially overlap, wherein the transmission line is on the first surface of the dielectric substrate;

in the direction perpendicular to the first surface of the dielectric substrate, the dielectric layer is between the insulating layer and the transmission line; and the insulating layer is between the dielectric layer and the metal layer.

3. The phase shifter according to claim 2, further comprising a connection layer, wherein the connection layer is electrically connected to the metal layer.

4. The phase shifter according to claim 3, wherein the connection layer comprises a ground layer on a second surface of the dielectric substrate away from the first surface.

5. The phase shifter according to claim 4, further comprising a connection line, wherein the connection line is configured to electrically connect the ground layer and the metal layer.

6. The phase shifter according to claim 4, wherein the metal layer comprises a plurality of metal blocks spaced apart from each other, and the plurality of metal blocks are all electrically connected to the connection layer, on a surface of the insulating layer away from the dielectric substrate, the plurality of metal blocks are arranged along a first direction, and an extension direction of the transmission line is in the first direction.

7. The phase shifter according to claim 3, wherein the connection layer comprises a first conductor portion electrically connected to the metal layer, the first conductor portion is on the first surface of the dielectric substrate, and the first conductor portion and the transmission line are spaced apart from each other.

8. The phase shifter according to claim 7, wherein the connection layer further comprises a second conductor portion electrically connected to the metal layer, the second conductor portion is on the first surface of the dielectric substrate, and the first conductor portion, the second conductor portion, and the transmission line are all spaced apart from each other.

9. The phase shifter according to claim 8, wherein on the first surface of the dielectric substrate, an extension direction of the transmission line, an extension direction of the first conductor portion, and an extension direction of the second conductor portion are all in a first direction;

the transmission line, the first conductor portion, and the second conductor portion are arranged along a second direction; and in the second direction, the transmission line is between the first conductor portion and the second conductor portion.

10. The phase shifter according to claim 3, wherein the metal layer comprises a plurality of metal blocks spaced apart from each other, and the plurality of metal blocks are all electrically connected to the connection layer, on a surface of the insulating layer away from the dielectric substrate, the plurality of metal blocks are arranged along a first direction, and an extension direction of the transmission line is in the first direction.

11. The phase shifter according to claim 10, wherein an orthographic projection of each of the plurality of metal blocks on the dielectric substrate partially overlaps an orthographic projection of the transmission line on the dielectric substrate.

12. The phase shifter according to claim 11, wherein the dielectric layer comprises a plurality of dielectric sub-layers that are in one-to-one correspondence with the plurality of metal blocks, and the plurality of dielectric sub-layers are spaced apart from each other; and the insulating layer covers the plurality of dielectric sub-layers and gaps between the plurality of dielectric sub-layers.

13. The phase shifter according to claim 10, wherein the dielectric layer comprises a plurality of dielectric sub-layers that are in one-to-one correspondence with the plurality of metal blocks, and the plurality of dielectric sub-layers are spaced apart from each other; and the insulating layer covers the plurality of dielectric sub-layers and gaps between the plurality of dielectric sub-layers.

14. The phase shifter according to claim 13, wherein an orthographic projection of each of the plurality of metal blocks on the dielectric substrate covers at least an orthographic projection of a corresponding dielectric sub-layer of the plurality of dielectric sub-layers on the dielectric substrate.

15. The phase shifter according to claim 2, further comprising a voltage control module, wherein the voltage control module is configured to control a voltage applied between the transmission line and the metal layer.

16. A drive method for driving the phase shifter according to claim 2, comprising:

applying a first voltage to the transmission line and applying a second voltage to the metal layer to adjust a capacitance value of an equivalent capacitor formed by the metal layer, the insulating layer, the dielectric layer, and the transmission line based on the first voltage and the second voltage.

17. The drive method for driving the phase shifter according to claim 16, wherein applying the first voltage to the transmission line and applying the second voltage to the metal layer to adjust the capacitance value of the equivalent capacitor formed by the metal layer, the insulating layer, the dielectric layer and the transmission line based on the first voltage and the second voltage, comprises:

controlling the first voltage to be greater than the second voltage, so that the capacitance value increases as an absolute value of a voltage difference between the first voltage and the second voltage increases, wherein the capacitance value remains unchanged upon increasing to a first specific value; and/or controlling the first voltage to be less than the second voltage, so that the capacitance value decreases as the absolute value of the voltage difference between the first voltage and the second voltage increases, wherein the capacitance value remains unchanged upon decreasing to a second specific value.

18. An electronic device, comprising a phase shifter, wherein the phase shifter comprises a dielectric substrate, a transmission line, a dielectric layer, an insulating layer, and a metal layer, and the transmission line, the dielectric layer, the insulating layer, and the metal layer are disposed with respect to the dielectric substrate, in a direction perpendicular to a first surface of the dielectric substrate, the dielectric layer and the insulating layer are between the metal layer and the transmission line, and a material of the dielectric layer is a semiconductor material; and an orthographic projection of the metal layer on the dielectric substrate, an orthographic projection of the insulating layer on the dielectric substrate, and an orthographic projection of the dielectric layer on the dielectric substrate at least partially overlap;

wherein the transmission line is on the first surface of the dielectric substrate;

in the direction perpendicular to the first surface of the dielectric substrate, the dielectric layer is between the insulating layer and the transmission line; and the insulating layer is between the dielectric layer and the metal layer.

* * * * *